United States Patent [19]

Lanzani

[11] Patent Number: 4,959,967

[45] Date of Patent: Oct. 2, 1990

[54] AUTOMATIC DEVICE FOR PRODUCING ICE CUBES

[75] Inventor: Emanuele Lanzani, Milan, Italy

[73] Assignee: Frimont S.p.A., Milan, Italy

[21] Appl. No.: 356,438

[22] Filed: May 23, 1989

[30] Foreign Application Priority Data

Jul. 21, 1988 [IT] Italy ..... 21433 A/88

[51] Int. Cl.[5] ..... R25C 1/04

[52] U.S. Cl. ..... 62/138; 62/209

[58] Field of Search ..... 62/135, 138, 209, 347

[56] References Cited

U.S. PATENT DOCUMENTS

| | | | |
|---|---|---|---|
| 2,612,030 | 9/1952 | Ploeger | 62/135 X |
| 3,285,029 | 11/1966 | Pansing | 62/135 |
| 3,287,927 | 11/1966 | Jacobus | 62/135 |
| 3,298,189 | 1/1967 | Beck et al. | 62/135 |
| 3,977,851 | 8/1976 | Toya | 62/135 |
| 4,075,863 | 2/1978 | Wilson | 62/138 |
| 4,142,377 | 3/1979 | Fogt | 62/135 |

*Primary Examiner*—William E. Tapolcai

*Attorney, Agent, or Firm*—Abelman Frayne Rezac & Schwab

[57] ABSTRACT

An automatic device for producing ice cubes has separate probes for measuring the temperature of the environment, and, for measuring the temperature of water supplied to an input of the device, the probes being connected to a monitoring device operative to calculate the optimum operation of the device under any particular climatic conditions.

6 Claims, 1 Drawing Sheet

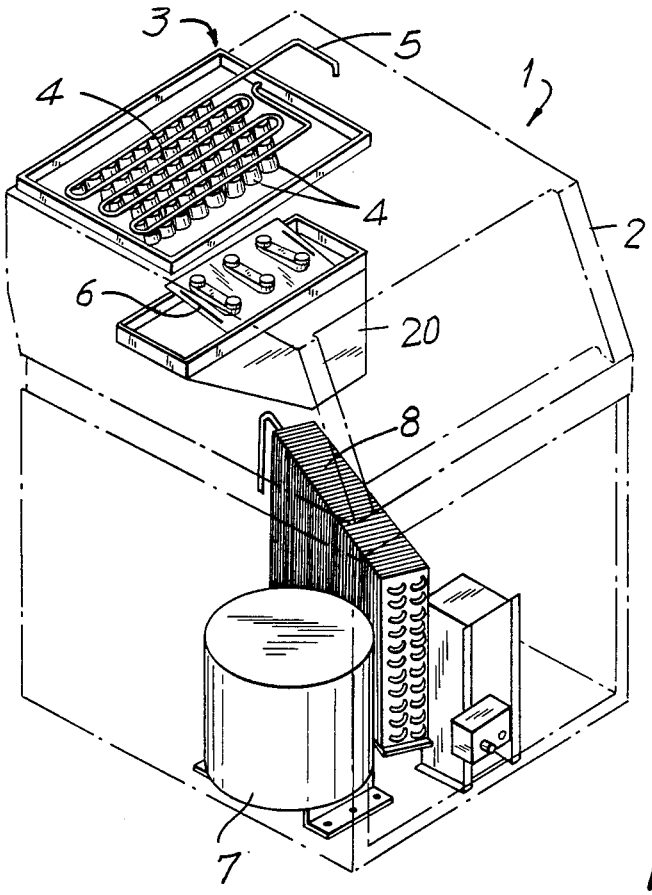
FIG. 1
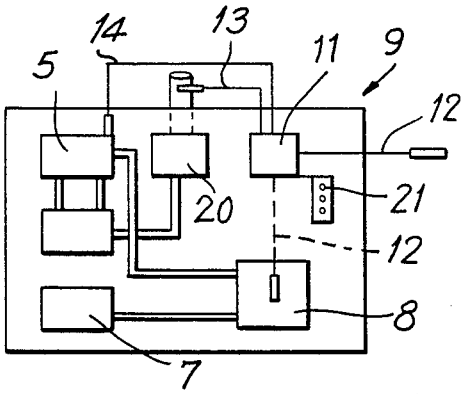
FIG. 2
FIG. 3
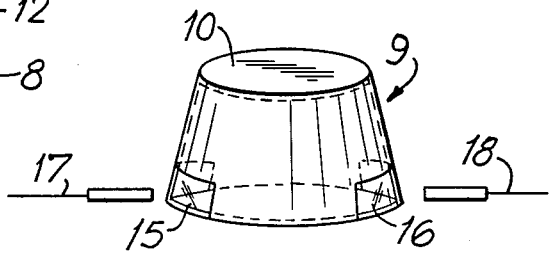

AUTOMATIC DEVICE FOR PRODUCING ICE CUBES

FIELD OF THE INVENTION

The present invention relates to an automatic apparatus for producing ice cubes.

BACKGROUND OF THE INVENTION

As is known, devices for producing ice cubes employ a thermostat capable of measuring the temperature of the evaporator, according to which the time required for the complete formation of the ice cubes is determined.

The cube forming time can be varied by an additional time period, which is adjusted by means of a timer, the timer exclusively performing the function of ensuring the complete formation of the ice cubes in production.

In known ice-cube forming devices, particularly larger sized devices, the thermostat is affected by variations in the temperature of the environment and which will vary in dependence on the geographical area in which the device is located.

In hot environments, the thermostat considerably increases the cube-forming time to beyond that at which the cubes are completely formed.

Conversely, if the temperature of the environment is relatively low, the thermostat automatically reduces the cube-forming time, and the cubes are sometimes ejected from said device before they are completely formed.

The above described function performed by the timer, i.e., to vary the cube-forming time when required, is very often insufficient to fully compensate for the anomalies in temperatures in the location where the device is placed after being sold.

In order to obviate these disadvantages, known devices must be adjusted at the location in which they are installed, independence on the climate and the temperature variations of the environment in which they are located, and, said adjustments must be performed at least at every change of season.

In order to reduce the costs arising from the above described disadvantages, pre-adjustments and pre-settings are sometimes performed before storing the devices in stock.

This solution, however, entails enormous difficulties in stock management and provides no useful effect, since the location to which the device ultimately will be shipped is usually unknown.

Given this situation, the aim of the present invention is to obviate the above described disadvantages of the known art.

SUMMARY OF THE INVENTION

Within the scope of this aim, an important object of the invention is to provide an automatic apparatus for producing ice cubes which does not require adjustments and settings according to the temperature of the environment, either when the machine is permanently installed or during its installation, this permitting warehousing of the devices in a very simple manner without division into batches destined for a specific country or region.

A further object of the invention is to provide an automatic apparatus for producing ice cubes which requires no pre-setting or pre-adjustment independence on the installation environment and installation site.

The automatic device for producing ice cubes comprises a supporting frame for cube-forming elements. Those elements comprise plurality of mutually aligned cups associated with an evaporator, and arranged opposite to devices for spraying water to be frozen. The device also comprise compressing and condensing means, and detecting means associated with cube forming elements to reverse the refrigeration cycle in order to separate the formed cubes from said cups. In accordance with the present invention, the detecting means comprises means for controlling the formation of at least on specimen cube, by varying the refrigeration time of the water employed to form the cubes, and, by varying the defrosting time required to separate the cubes from said cups.

DESCRIPTION OF THE DRAWINGS

Further characteristics and advantages of the invention will become apparent from the description of a preferred but not exclusive embodiment of the automatic apparatus for producing ice cubes according to the invention, illustrated only by way of non-limitative example in the accompanying drawings, in which:

FIG. 1 is a perspective cutout view of a device according to the invention;

FIG. 2 is a schematic view of the operation of the device according to the invention; and FIG. 3 is a schematic perspective view of the cube forming cup and of two optical probes adapted to detect the complete formation of an ice cube.

DESCRIPTION OF THE PREFERRED EMBODIMENTS

With reference to the above described figures, the device for automatically producing ice cubes according to the invention, is indicated generally by the reference number 1, and includes a supporting frame 2 for cube-forming elements indicated generally by the reference number 3 and which are comprised by a plurality of cups 4, each associated with an evaporator 5.

Means 6 for spraying water is located beneath said cups 4 and is adapted to spray upwardly into water the interior of said cups 4 so as to form ice-cubes therein.

The device also includes compressor means 7 and condenser means 8 required for its operation, and which are interconnected in series with the condenser 5 by appropriate conduits which are not illustrated in the drawings.

The apparatus also includes any convenient form of detection means which is associated with the cups 4, and which is operative to reverse the refrigeration cycle to separate the formed ice cubes from the cups.

The detection means comprise means 9 for monitoring the formation of at least one specimen cube 10, so as to vary the refrigeration time and the defrosting time based on preset and optimum times.

The detection means also includes electronic analysis elements that include a microprocessor-based microcomputer 11 which connected to a first probe 12 adapted to measure the temperature of the environment in which the apparatus is located and/or the temperature at the output of the condensing means 8.

A second probe 13 is connected to the microcomputer 11, and is adapted to measure the temperature of water supplied to the apparatus and which is collected in a tank 20 and subsequently sprayed into the cups 4 by the sprayer means 6.

The first probe's detection of the temperature at the output of the condenser prevents the efficiency of said condenser from affecting the cube forming time. Dirt in the condenser circuit or insufficient gas pressure, each would cause lower efficiency of said condenser.

The microcomputer 11 processes the monitored data and after analyzing it then issues commands for setting the optimum refrigeration time for forming said cubes, and, subsequently issues commands for setting the optimum defrosting time to cause said cubes to drop from their cups.

A third probe 14 is connected to the microcomputer 11 and is adapted to detect the temperature of a plurality of ice cubes and the temperature of the evaporator and to send the necessary information to the microcomputer 11 which processes the information and sends signals to the electromechanical components to provide the optimum refrigeration time and defrosting time of the apparatus.

The microcomputer is programmed with information corresponding to the characteristic operating curves of the different models of the ice-making devices.

During the manufacture of the apparatus, the characteristic curve related to the kind of device is selected.

The monitoring means further includes, at least two optical probes 17 and 18 which can be arranged coaxial to one another and on opposite sides of a cup 10 which has portions 15, 16 made of tranparent material and which are connected to the microprocessor 11.

The optical probes are of any known type and are conveniently arranged opposite that part of the cup which has the largest diameter, since the cube will tend to form more slowly in this larger-diameter region.

The optical probes 17 and 18 may operate with laser beams or with infrared rays in accordance with the requirements and choices of the manufacturer to provide an indication of the presence and thickness of the scanned portion of the ice cube contained within the cup. As is well known, one of the probes can be an emitter and the other a sensor, the thickness of the forming ice constituting a progressively increasing impedance to light transmission.

As the ice forms, the optical probes exhibit a drop in the output voltage of the sensor of approximately 60%.

The microprocessor 11 comprises a plurality of indicators 21 employed for checking the machine's various components.

For example, checking of the condenser to detect if it is dirty or not, and therefore has a high or low condensing temperature, and, a check to determine whether sufficient water is available for producing ice cubes in the apparatus.

During the step of refrigeration and therefore of forming of the ice cubes, the compressor, the water pump and the fan are activated, and the optimum cube forming time and their optimum defrosting time for subsequently separating them from their supporting cups are preset by means of the probes 12, 13 and 14.

The invention thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. An automatic device for producing ice cubes, comprising a supporting frame for cube forming elements comprised by a plurality of mutually aligned cups supported by said frame and associated with an evaporator, said cups being arranged opposite to means for spraying water to be frozen, compressor and condenser means, and, detector means associated with said cube-forming elements and operative to reverse the refrigeration cycle to separate said cubes from said cups, said detector means comprising means for checking the formation of at least one specimen cube, for varying the refrigeration time of the water employed to form said cubes and for varying the defrosting time of said cubes required to separate them from said cups, further including monitoring means having electronic analysis elements defined by at least one electronic board, at least one first probe connected to said monitoring means for measuring one of the temperature of the environment and the temperature of the output of said condenser means, and at least one second probe connected to said monitoring means for measuring the temperature of water supplied to an input of the device.

2. The device according to claim 1, including at least one third probe connected to said monitoring means for monitoring the temperature of a series of said cubes, said probe cooperating with said first probe to compute the variation of said refrigerating and defrosting times.

3. The device according to claim 1, including at least two optical probes connected to said monitoring means and arranged coaxially on opposite sides with respect to at least one cup which has, proximate to each of said probes, portions made of a transparent material.

4. The device according to claim 3, in which said optical probes are laser-beam probes.

5. The device according to claim 3, in which said optical probes are infrared-ray probes.

6. The device according to claim 3, in which said transparent portions are arranged at a larger diameter portion of said cup.

* * * * *